US007007772B2

(12) United States Patent
Argoud

(10) Patent No.: US 7,007,772 B2
(45) Date of Patent: Mar. 7, 2006

(54) FALL-ARRESTING DEVICE

(76) Inventor: Rodolphe Argoud, 301 route de la Peteree, Corps d Uriage, F-38410 St. Martin d'Uriage (FR)

( * ) Notice: Subject to any disclaimer, the term of this patent is extended or adjusted under 35 U.S.C. 154(b) by 0 days.

(21) Appl. No.: 10/169,552

(22) PCT Filed: Jan. 16, 2001

(86) PCT No.: PCT/FR01/00132

§ 371 (c)(1),
(2), (4) Date: Jul. 17, 2002

(87) PCT Pub. No.: WO01/52938

PCT Pub. Date: Jul. 26, 2001

(65) Prior Publication Data

US 2003/0029672 A1 Feb. 13, 2003

(30) Foreign Application Priority Data

Jan. 17, 2000 (FR) ..... 00 00541

(51) Int. Cl.
*A62B 1/14* (2006.01)

(52) U.S. Cl. ..... 182/36

(58) Field of Classification Search ..... 182/3, 182/4, 5, 65.2, 65.5, 36, 192, 234; 104/91, 104/115, 182
See application file for complete search history.

(56) References Cited

U.S. PATENT DOCUMENTS

| | | | | |
|---|---|---|---|---|
| 3,811,155 | A * | 5/1974 | Stafford | 24/115 G |
| 4,846,075 | A * | 7/1989 | Tupper | 104/209 |
| 5,934,408 | A * | 8/1999 | Flux | 182/5 |
| 6,155,384 | A * | 12/2000 | Paglioli | 188/65.2 |
| 6,311,625 | B1 * | 11/2001 | Ostrobrod | 104/91 |
| 6,467,574 | B1 * | 10/2002 | Lara | 182/36 |
| 6,530,454 | B1 * | 3/2003 | Renton et al. | 182/36 |
| 6,591,940 | B1 * | 7/2003 | Desjardins | 182/36 |
| 6,843,346 | B1 * | 1/2005 | LeBeau et al. | 182/5 |
| 2002/0050421 | A1 * | 5/2002 | Lara | 182/36 |
| 2002/0112916 | A1 * | 8/2002 | Ador | 182/5 |

* cited by examiner

*Primary Examiner*—Alvin Chin-Shue
(74) *Attorney, Agent, or Firm*—Oliff & Berridge, PLC

(57) ABSTRACT

A fall-arresting device includes a body which has a runner, two pivoting cams, and a system for actuating at least one of these cams in the event of the user or of a load falling.

The body has an elongate opening intended to accommodate the member allowing the user to be harnessed to the device, particularly a shackle, and
the two cams are placed some distance apart.

The system for actuating the cams includes at least one finger secured to a cam, each finger lying in the path followed by the shackle in said the opening if the user or the load falls.

13 Claims, 11 Drawing Sheets

FALL-ARRESTING DEVICE

BACKGROUND OF THE INVENTION

The present invention relates to a fall-arresting device intended to afford the safety of a person who has to move around at a height, or, in general, to prevent any load that has to be moved around at a height from falling.

This device is of the type intended to be engaged and moved normally along a retaining support, such as a cable, a rope or a rail, and to jam onto this support if the person or said load falls. This jamming may also occur when tension needed to allow the device to move along an inclined portion of said retaining support is no longer exerted.

The invention can be used in particular to safeguard people working at a height or people engaged in sports or touristic activities during which they need to be safeguarded against falling.

DESCRIPTION OF THE PRIOR ART

Devices of this kind intended to be used only along a vertical cable and unable to slide except in one direction with respect to this retaining support exist. The movement of such a device in the opposite direction to the normal direction of travel entails manual action on the part of the user.

Other devices are intended to be used only along a horizontal cable. These devices comprise no jamming system and the cable is the only safeguard against falling. The use of such devices is forbidden as soon as the inclination of the cable exceeds 15 degrees.

There is another device which can be moved, in one direction or the opposite direction, along a cable comprising one or more vertical and/or horizontal and/or inclined portions. This device comprises:

- a body which has a curved part, hereinafter known as a "runner", which can be engaged over and moved along a cable;
- two jamming cams mounted so that they can pivot on the body and able, in the retracted position, to allow the cable to run between them and the runner and, in an active position, to clamp the cable between them and the runner so as to prevent the device from moving along the cable; and
- a system for actuating the cams, which is formed by two link rods connected together by one end and by two linkages connected to these link rods on the one hand and to the cams on the other hand; these link rods and linkages between them delimit an elongate opening, parallel to the cable, through which the member by which the user harnesses himself to the device, particularly a shackle, can be engaged.

The cams of this device are normally kept in the active position. Tension on the shackle at right angles to the cable allows these cams to be brought into the retracted position to allow the device to be moved along.

If the user falls along a vertical or inclined cable, the shackle moves toward one of the ends of said opening, and therefore no longer exerts said tension, which means that the cams return to the active position, thus jamming the device.

This device has the disadvantage that its structure is relatively complex, cumbersome and expensive as a result, in particular, of the strong structure that the aforementioned link rods and linkages have to have, together with the pins that allow these to pivot, so as to withstand the forces generated by the user falling.

In addition, the configuration of said opening is such that the cams pivot into the active position only when the shackle reaches the corresponding end of this opening. This configuration makes it possible for the device to disengage from the cable when, at the start of the fall, said tension of the shackle at right angles to the cable ceases. In addition, this device does not seem able to jam itself correctly below a cable inclination of 45 degrees.

The present invention aims to overcome these essential drawbacks.

SUMMARY OF THE INVENTION

In particular, the object of the invention is to provide a fall-arresting device which can be used with horizontal, vertical or inclined retaining supports or ones comprising horizontal, vertical and/or inclined portions; this device needs to be able to operate in both directions of travel along the retaining support, needs to be able to be transferred easily past structures which anchor the retaining support, needs to be able to be fitted onto any point of the retaining support, and needs to maintain a relatively simple, lightweight and inexpensive structure.

Another object of the invention is to provide a fall-arresting device entailing deliberate action on the part of the user in order to move the device along the retaining support, and which jams immediately when, on an inclined portion of said retaining support, said deliberate action ceases.

The device concerned comprises, in a way known per se, a body and two cams such as the aforementioned, and a system for actuating at least one of these cams.

According to the invention,

- the body has an elongate opening, the length of which is directed parallel to the retaining support when the device is engaged over this retaining support, this opening being intended to accomodate the member that allows the user or the load to be harnessed to the device, particularly a connector of the safety shackle type;
- the two cams are placed some distance apart; and
- the system for actuating the cams comprises at least one finger secured to a cam, each finger projecting on the opposite side to the runner and having a length such that it lies in the path followed by said connector in said opening in the event of the user or of the load falling, so that the connector acts on this finger in the event of such a fall so as to bring the cam connected to this finger into the active position.

The body thus comprises an opening that accommodates the connector, thus eliminating the aforementioned link rods and linkages; the action of the connector directly against one or other of said fingers allows immediate pivoting of a cam in the event of a fall, even when the retaining support is not very steeply inlined, without any risk of the device opening up.

Furthermore, the two spaced-apart cams stabilize the device along the retaining support, and this allows this device to be used in either one of its directions of travel from the retaining support. This spacing of the cams also makes it possible to avoid any tilting of the device with respect to the retaining support, which tilting would be likely to cause unwanted locking-up of this device as it passed a structure for the anchoring of the retaining support.

As a preference, at least one cam is not placed normally in its aforementioned retracted position but, by virtue of spring means associated with it, is placed normally in a position of lightly clamping the retaining support, to sufficient an extent to prevent the device from moving freely along this retaining support; the device is then equipped with a member for actuating this cam; this member has a part against which said connector can bear and a part connected to the aforementioned finger of the cam, and is shaped so that when tension is exerted on the connector in a direction substantially perpendicular to the retaining support, it moves this finger from the aforementioned position of light clamping to the position of retraction of the cam and so that if the user falls, it does not impede the connector coming to bear against this finger.

The movement of the device is thus normally prevented, and this is advantageous when the retaining support is vertical or inclined; to free the device so that it can move, the user exerts tension on said connector at right angles to the retaining support.

As soon as the tension on the connector ceases, the cam or cams return to their position of lightly clamping the retaining support, and this has the effect of immobilizing the device from the retaining support; if the user or the load should fall, this immobilization allows the connector to come immediately to bear against the finger of a cam in order to jam the device. Very effective and very reliable operation of this device is thus obtained.

According to a first embodiment of the invention in this case, each cam comprises a finger for actuating it and the device comprises two link rods mounted to pivot on said body, namely

- a first link rod of which a part, situated on one side of the axis of pivoting of the link rod, extends at the level of the central region of said opening and of which the other part, situated on the other side of this axis of pivoting, comes into engagement with one of said fingers, and
- a second link rod of which one part, situated on one side of the axis of pivoting of the link rod, extends at the level of the central region of said opening and of which the other part, situated on the other side of this axis of pivoting, comes into engagement with the other of said fingers.

The connector, when said tension is exerted on it, bears against the parts of the link rods which are situated at the central region of the opening, and this brings these link rods to move the cams toward their position of retraction.

According to a second embodiment of the invention, in the same case, each cam comprises a finger for actuating it and the device comprises a flexible link connecting these two fingers together, the length of the link being such that the connector, when said tension is exerted on it, bears against the central region of this link so as to move the fingers into their position corresponding to the position of retraction of the cams.

Advantageously, the edge of the body of the device delimiting the lower part of said opening has a region of concave shape in which the connector is engaged when said tension essentially perpendicular to the retaining support is exerted on it.

The connector is thus held in this concave region when the tension is exerted, and this greatly reduces the risk of unwanted jamming of the device while this device is being moved along the retaining support or while it is moving past a structure that anchors the retaining support.

As a preference, this concave region is bordered by two convex regions which contribute to limiting the unwanted movement of the connector in said opening.

Advantageously, the runner and each cam are shaped in such a way as, when this cam is in a determined angular position, to allow the retaining support to be engaged laterally between this runner and this cam.

The device can thus be engaged on the retaining support at any point thereof, simply by bringing one cam and then the other into this determined angular position.

As a preference, in this case, each cam and the finger connected to it are shaped in such a way that the finger finds itself near the finger of the other cam in said determined angular position, and in such a way that this same determined angular position can be reached only if the connector has been removed from said opening.

It is therefore necessary to remove the connector in order to bring the cams in turn into their determined angular positions, something which prevents any removal of the device from the retaining support as long as the connector is attached to the device. Additional safety against any risk of incorrect use of the device is thus obtained.

Advantageously, the device comprises at least one removable stop associated with a cam or two removable stops each of which is associated with one of the cams, this stop, when active, preventing the cam from entering a determined angular position that allows the retaining support to be engaged laterally between this runner and this cam and, in its retracted position, not impeding the arrival of the cam in this determined angular position.

This stop constitutes an additional safety feature because it entails a deliberate action on the part of the user in order to retract the cam so as to put the device on the retaining support or remove it therefrom.

BRIEF DESCRIPTION OF THE DRAWINGS

For its full understanding, the invention is described once again hereinbelow with reference to the appended schematic drawing which, by way of nonlimiting example, depicts three possible embodiments of the device to which it relates.

DESCRIPTION OF THE PREFERRED EMBODIMENTS

Figure 1:
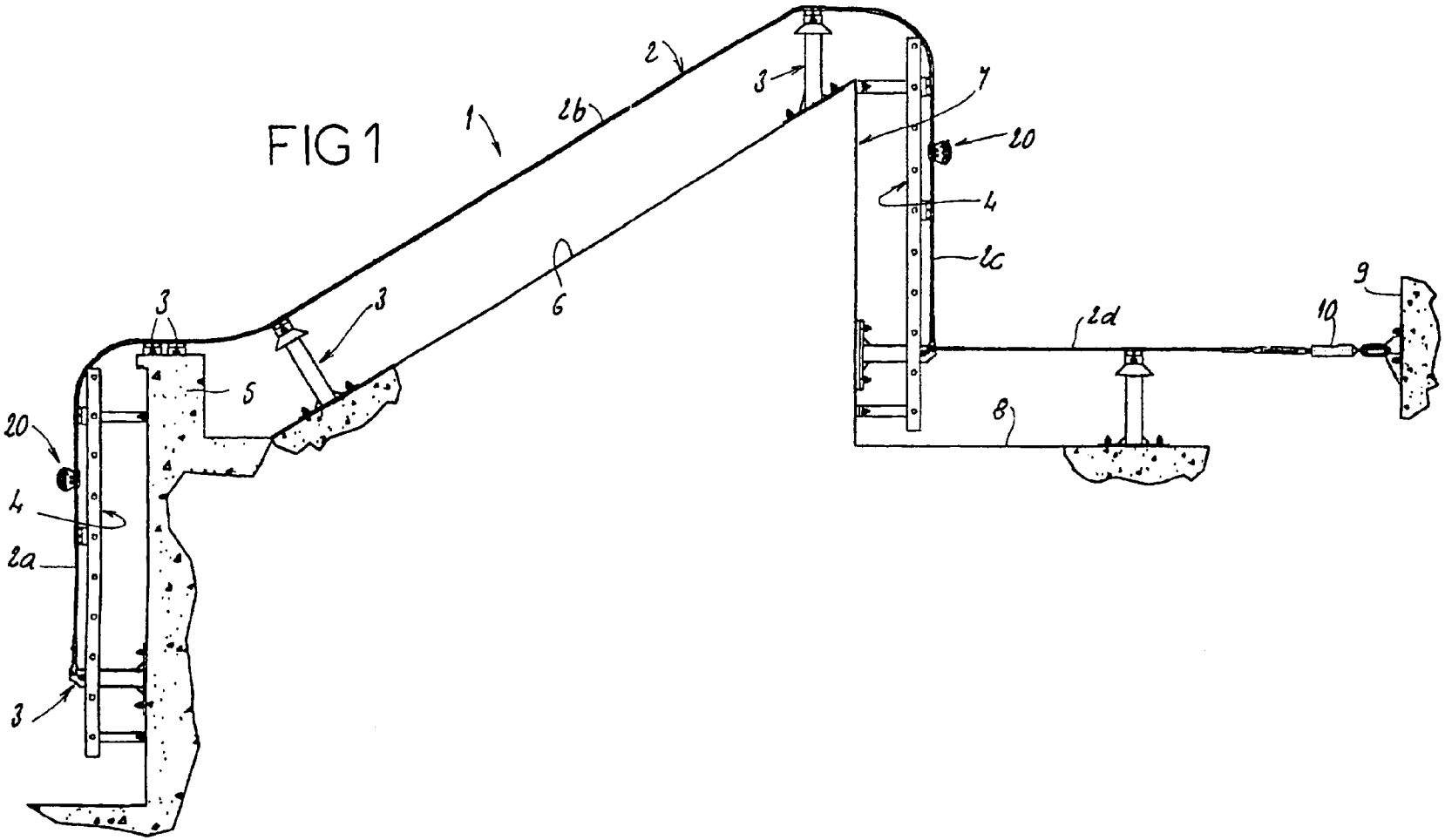
FIG. 1 is a side view of a building on which a person has to work high up, this building being equipped with a retaining support to safeguard this person against falling.

FIG. 1 depicts a building 1 on which a person has to work, placed high up, so that this person has to be safeguarded against falling. To this end, the building 1 is equipped with a retaining support 2 connected, by anchoring structures 3, in the regions concerned, to ladders 4, to a low wall 5, to the inclined wall 6 of an edicule 7 or to a terrace 8. In the example depicted, one end of the retaining support 2 is fixed to a ladder 4 and the other end is connected to a vertical wall 9 via a stretching screw 10.

The retaining support 2 thus has a vertical portion 2*a* that the user has to travel in the upwards direction in order to reach the terrace 8, an inclined portion 2*b*, a vertical portion 2*c* that the user has to travel in the downward direction to reach the terrace 8, and a horizontal portion 2*d*.

Figure 6:
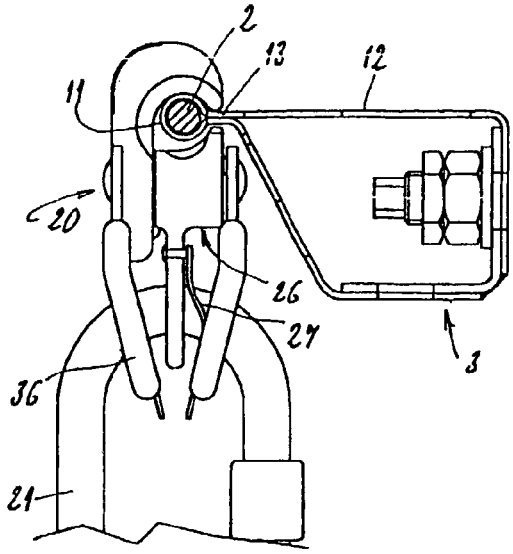
FIG. 6 is a side view similar to FIG. 3, when negotiating a structure that allows the retaining support to be anchored to the building.

With reference to FIG. 6, it is apparent that each anchoring structure 3 comprises a sleeve 11 surroung the retaining support 2, a base 12 fixed to the building 1 or to a ladder 4, and a connecting part 13 connecting this sleeve 11 to this base 12.

Figure 2:
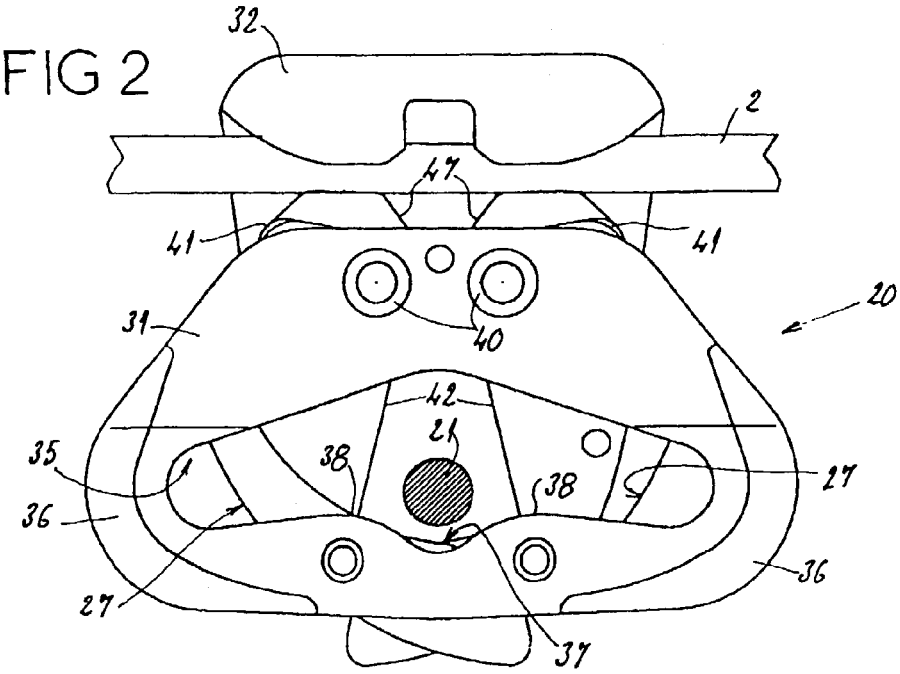
FIG. 2 is a front view of the fall-arresting device according to a first embodiment, which can be engaged and moved on said retaining support, this figure also depicting in cross section the connector that allows the user to harness himself to this device.
Figure 3:
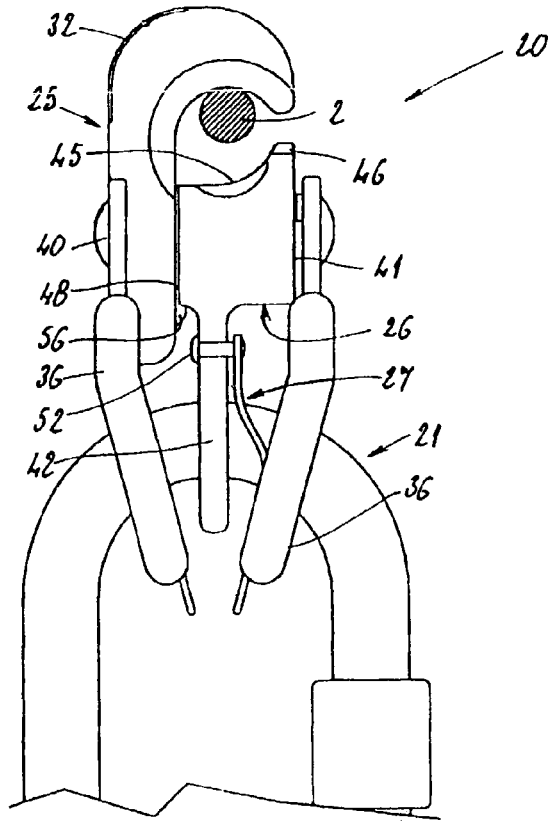
FIG. 3 is a side view of this device, the retaining support being viewed in section.
Figure 4:
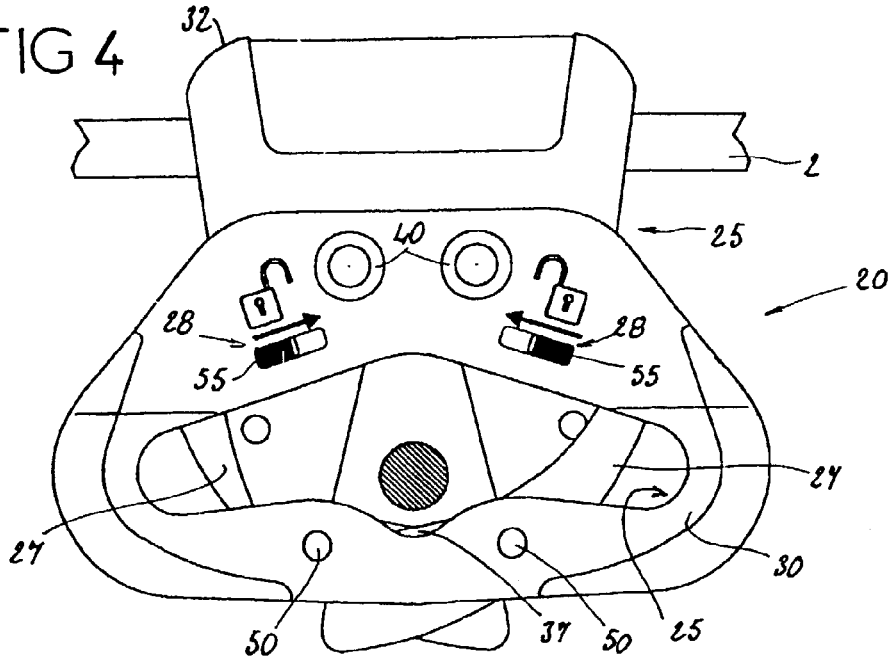
FIG. 4 is a view similar to FIG. 2, from the back.

The device 20 depicted in FIGS. 2 to 4 is intended to be engaged on the retaining support 2 and to be moved along the portions 2*a* to 2*d* thereof; this device 20 acts as an anchoring point for anchoring to a connector 21 of the safety shackle type intended to be connected, directly or via a lifeline, to a harness worn by the user.

As can be seen, this device comprises a body 25, two parts 26 mounted to pivot in this body 25, two pivoting link rods 27 and two locking assemblies 28.

The body 25 is formed of two flanges 30, 31 and of a curved part 32 hereinafter known as the "runner" secured to the flange 30. This runner 32 is able to be engaged over the retaining support 2 and to be moved along the latter.

The two flanges 30, 31 have identical shapes, elongate in the direction parallel to the retaining support 2. Each has an elongate opening 35 parallel to the retaining support 2, and the two openings 35 of the two flanges are placed facing each other. These openings 35 are able to accommodate the shackle 21, as shown in particular in FIG. 3.

The flanges 30, 31 have coverings 36 to make the edges of their ends non-aggressive toward the user.

The edges of the flanges 30, 31 delimiting the openings 35 in the lower part have a concave central region 37 bordered by two convex regions 38.

The two flanges 30, 31 are joined together by two riveted spindles 40, which also act as pivot pins for said parts 26.

The latter are placed side by side. Each of them has a part forming a cam 41 and a part forming a finger 42, these parts 41 and 42 being known hereinafter as "cam" and "finger" for simplicity.

Figure 5:
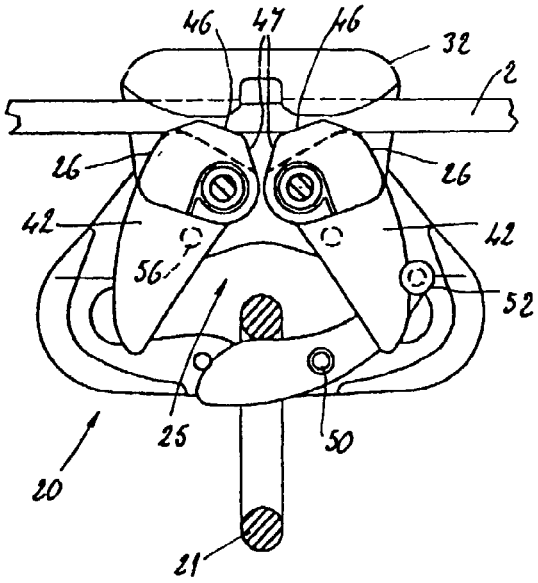
FIG. 5 is a front view, in an operating position, the device being depicted with one of its flanges and one of its link rods removed, to make the drawing clearer.

Each cam 41 is associated with a spring engaged on its axis, which normally keeps it in the position shown in FIG. 5. It has a rounded clamping wall 45 delimited, on the same side as the flange 31, by an edge 46 and comprises, on its internal side, that is to say on its side facing towards the other cam, an inclined face 47. Each cam 41 also has an edge 48 facing towards the internal face of the runner 32.

Figure 7:
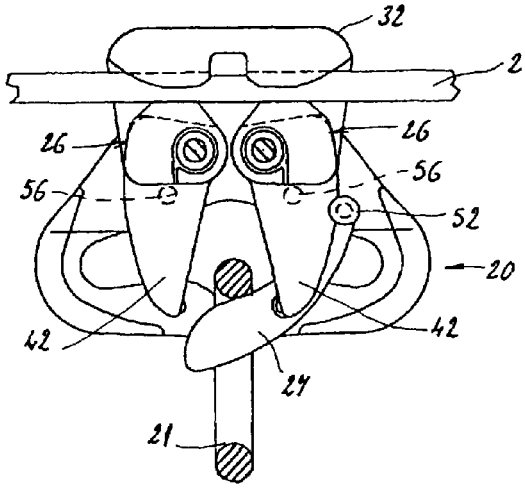
FIG. 7 is a view thereof similar to FIG. 5, in another operating position.
Figure 8:
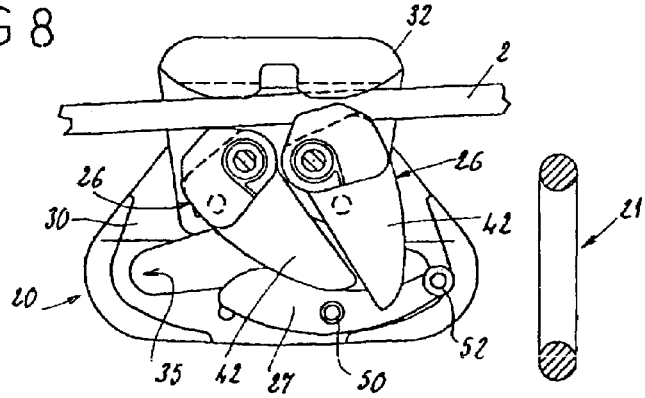
FIG. 8 is a view thereof similar to FIG. 5, during its fitment on the retaining support or its removal therefrom.
Figure 9:
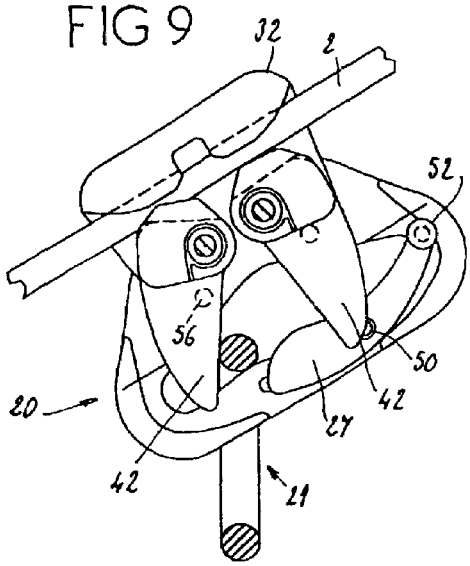
FIG. 9 is a view thereof similar to FIG. 5, in the jamming position on an inclined portion of a retaining support.
Figure 10:
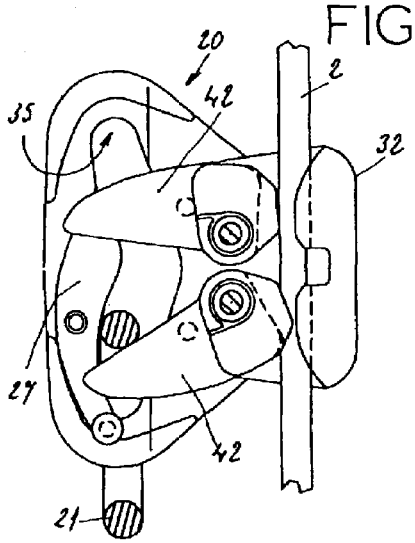
FIG. 10 is a view vue thereof similar to FIG. 5, in a jammed position on a vertical portion of the retaining support.
Figure 11:
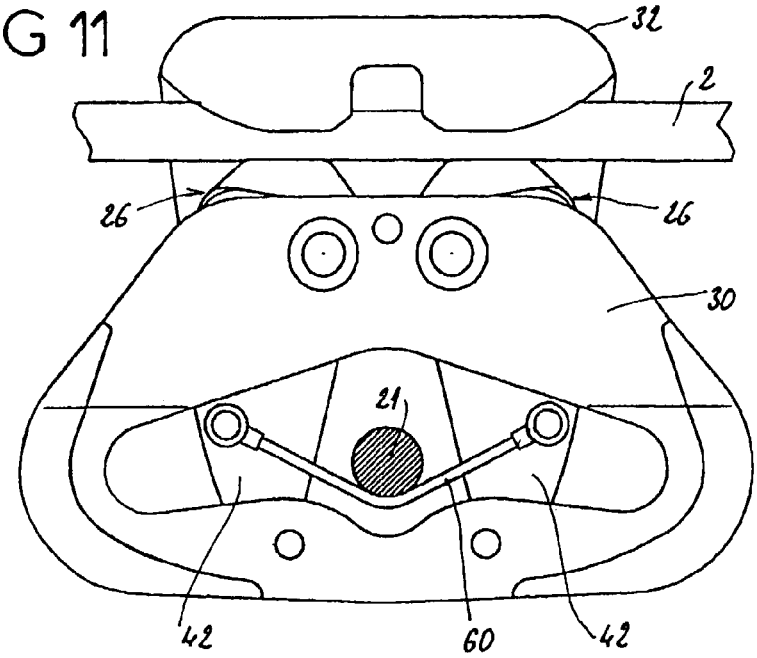
FIGS. 11 to 18 are views thereof according to a second embodiment, these figures being similar, respectively, to FIGS. 2 to 5 and 7 to 10.
Figure 12:
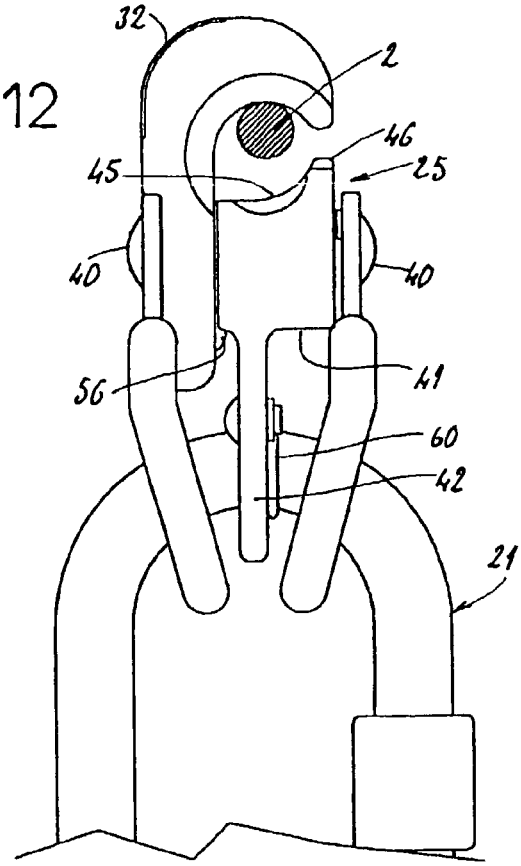
Figure 13:
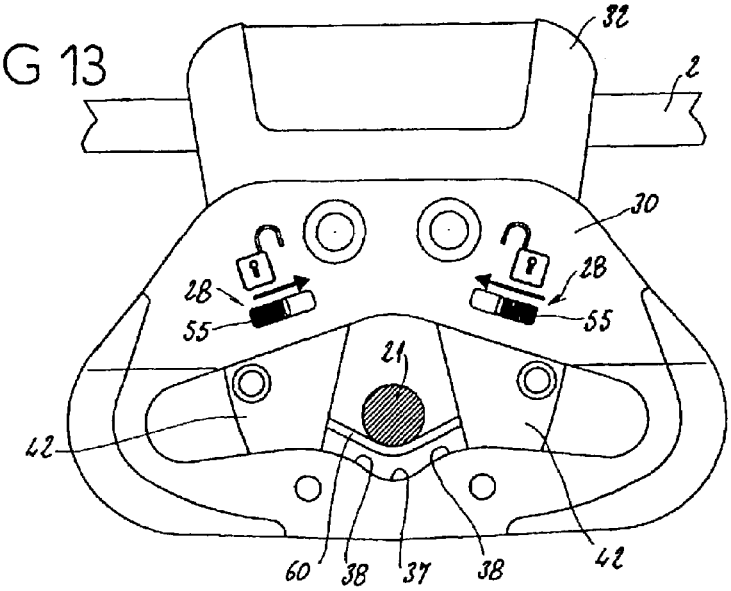
Figure 14:
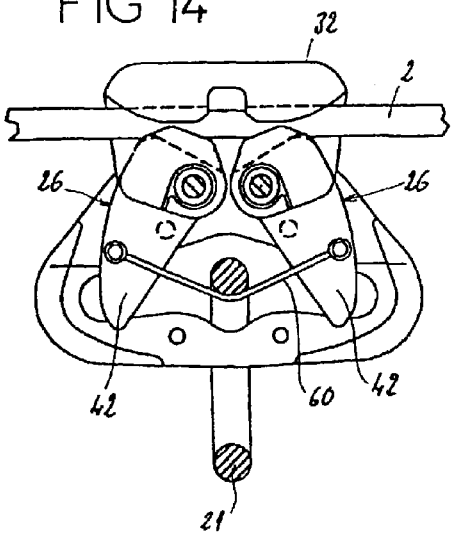
Figure 15:
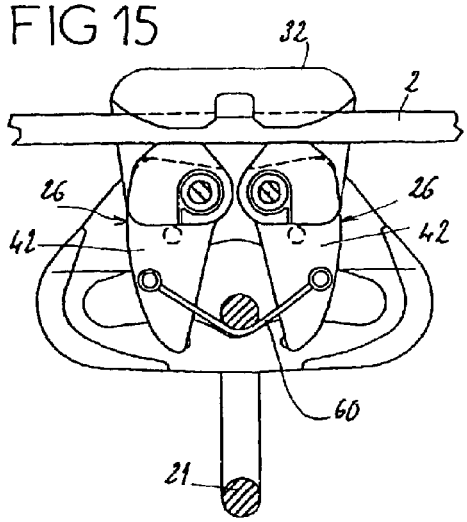
Figure 16:
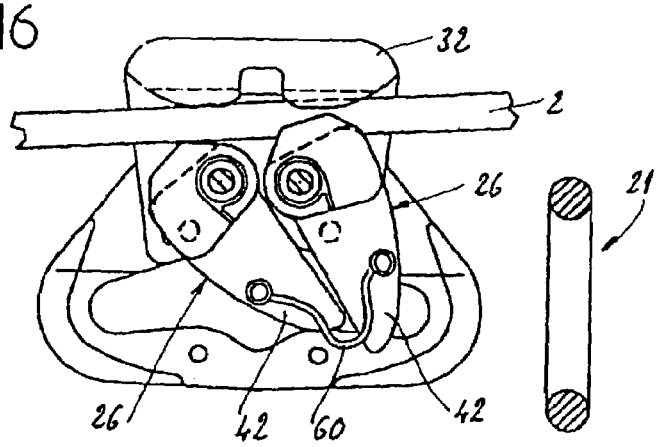
Figure 17:
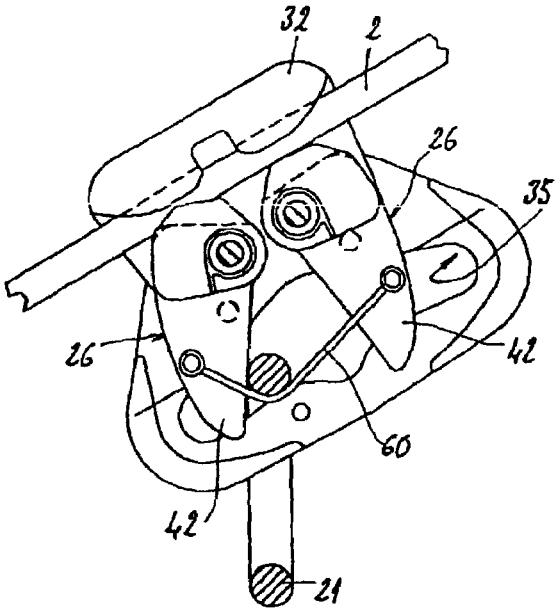
Figure 18:
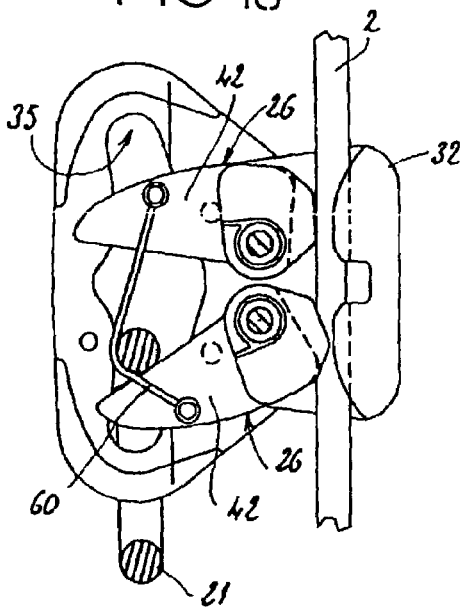
Figure 19:
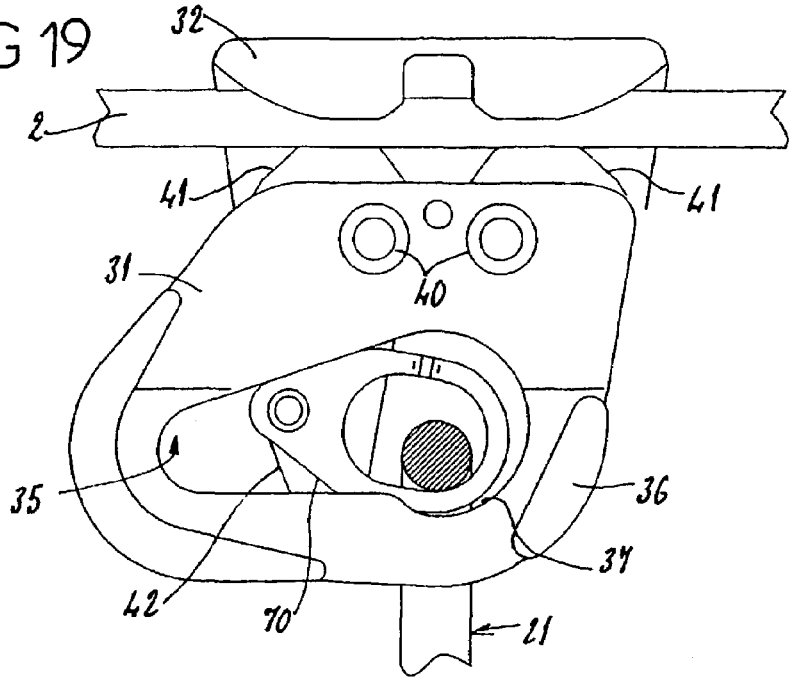
FIGS. 19 to 26 are views according to a third embodiment, these figures being similar, respectively, to FIGS. 2 to 6 and 8 to 10.
Figure 20:
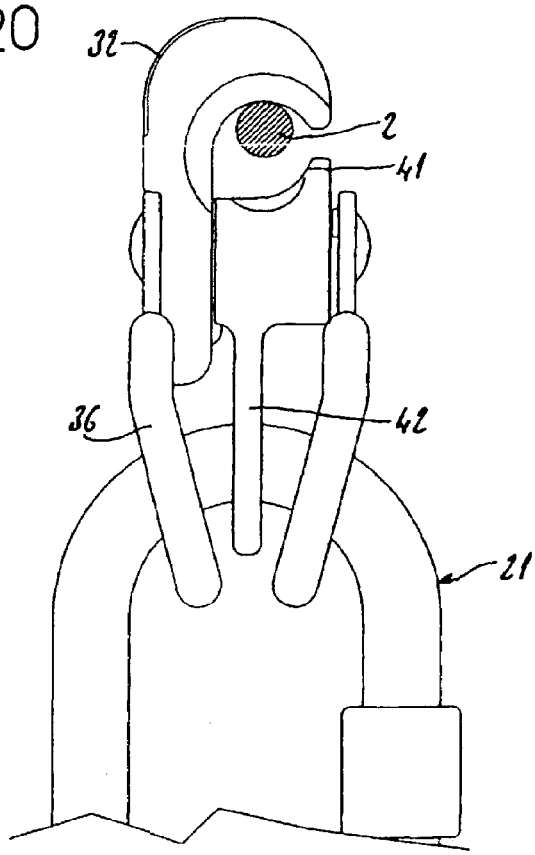
Figure 21:
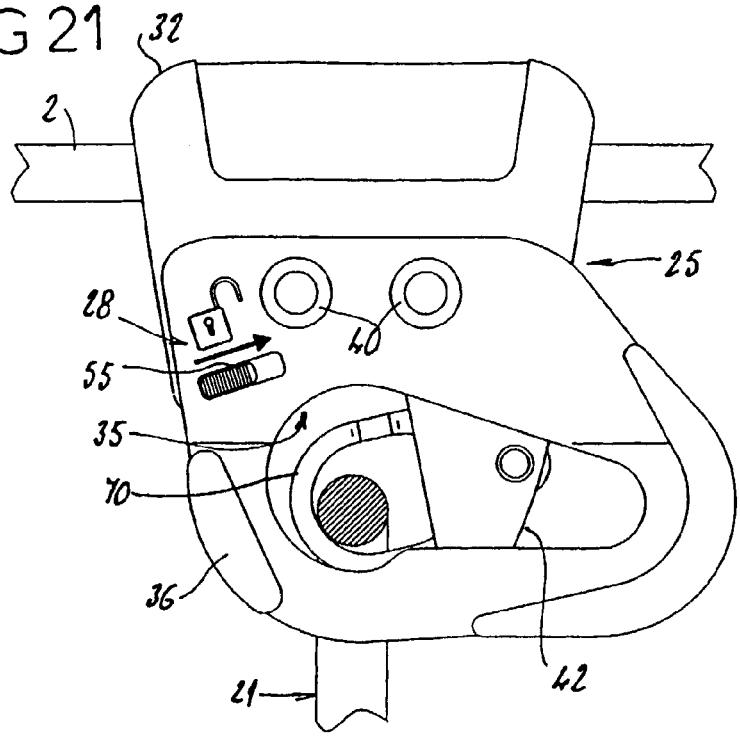
Figure 22:
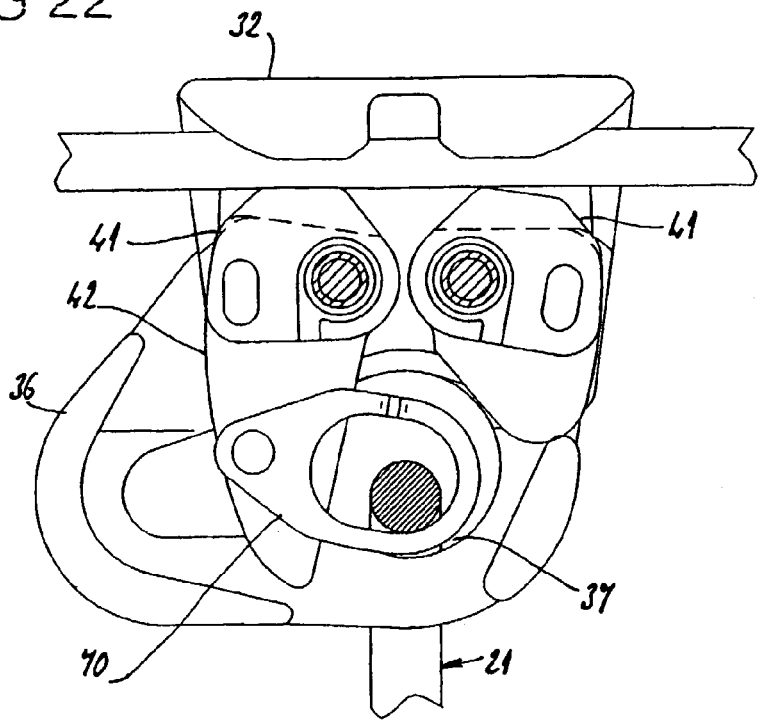
Figure 23:
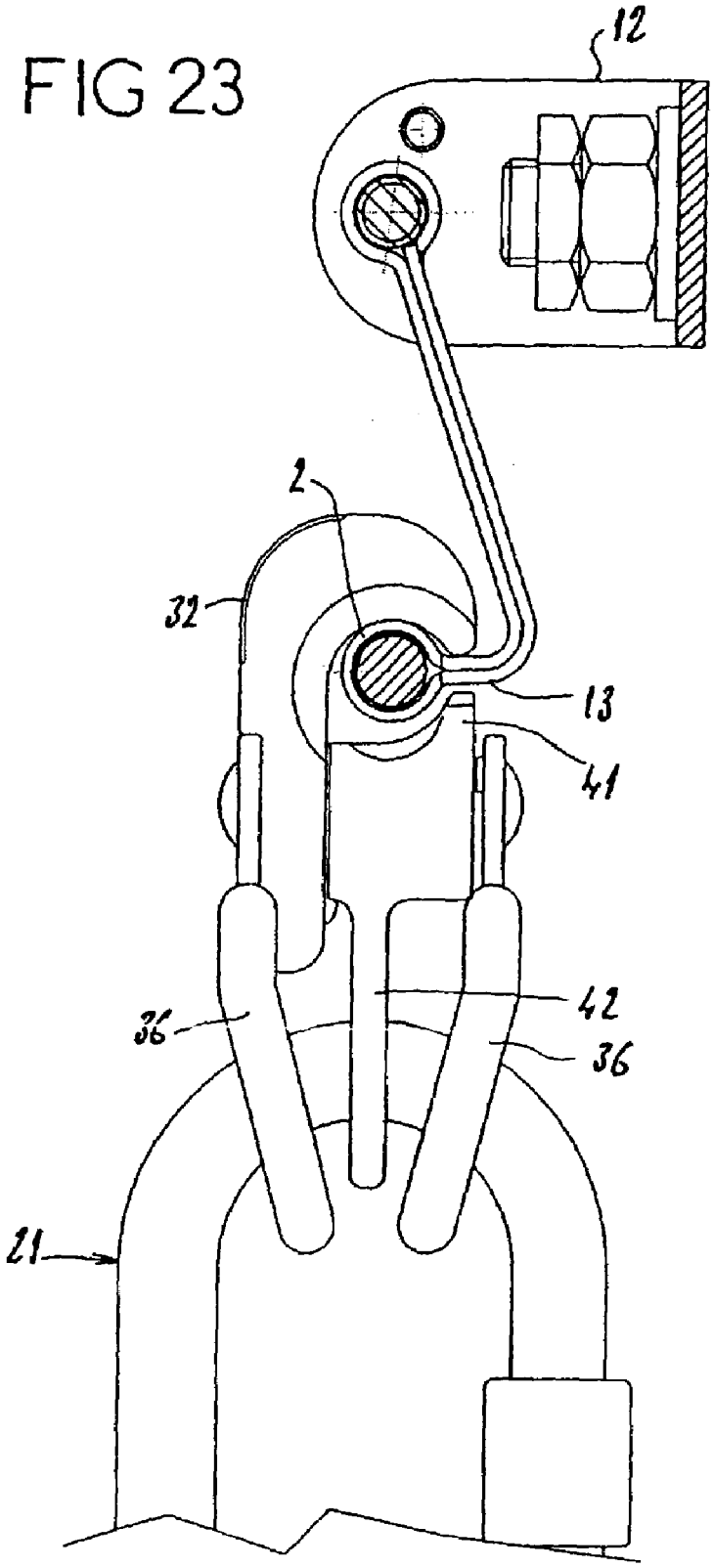
Figure 24:
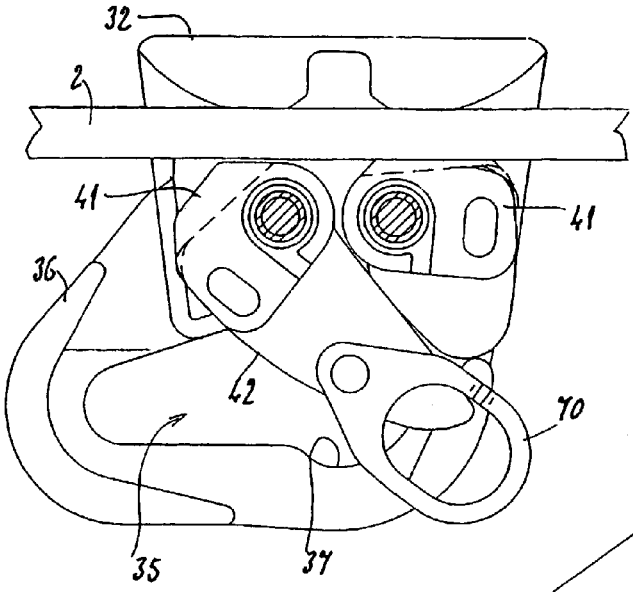
Figure 25:
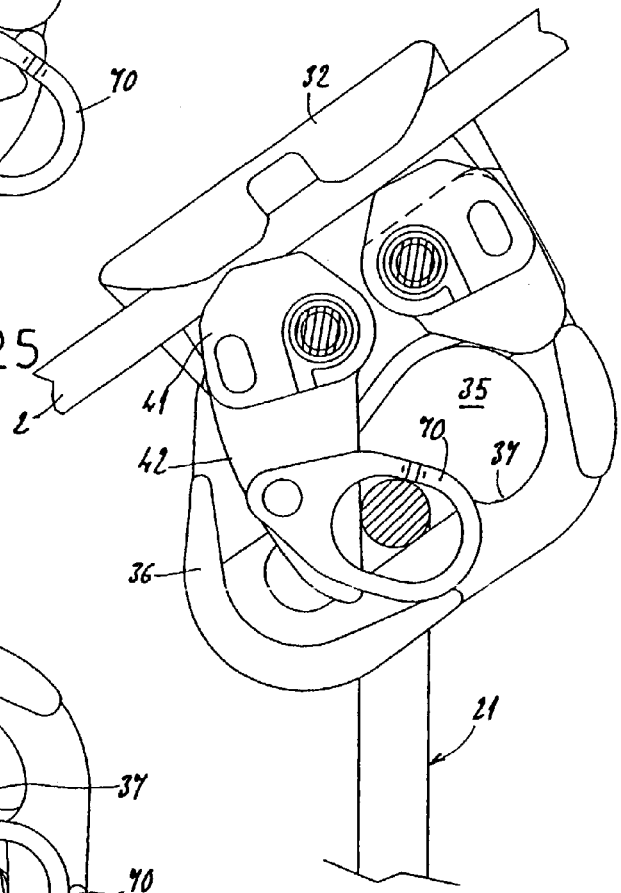
Figure 26:
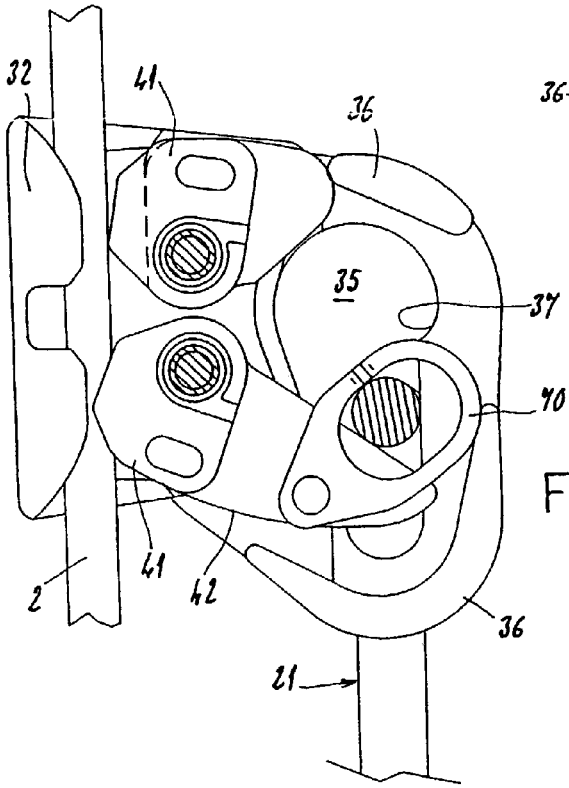

The shape of these cams 42 is such that:

in the position of pivoting of the parts 26 as shown FIG. 5, the cams 41 apply a slight clamping to the retaining support 2, to sufficient an extent to immobilize the device 20 on the retaining support 2;

in the position of pivoting of the parts 26 as shown in FIGS. 6 and 7, the wall 45 is kept some distance away from the retaining support 2 and allows the device 20 to be moved, while the edge 46 is kept a distance away from the runner 32 which is shorter than the diameter of the retaining support 2 but greater than the thickness of the part 13 of a structure 3;

in the position of pivoting of the part 26 as shown in the left-hand side of FIG. 8, the face 47 of the cam 41 faces the runner 32 and is placed a distance away from the latter which is slightly greater than the diameter of the retaining support 2, thus allowing the retaining support 2 to be engaged between the cam 41 and the runner 32;

the parts 26 located to the left in FIG. 9 and in the lower part of FIG. 10 perform, in their positions of pivoting depicted, intensive clamping of the retaining support 2, jamming the movement of the device 20 along this retaining support 2 if the user should fall.

The fingers 42 have a length such that they extend through the openings 35. The shape of their internal edges is such that, in the position of the parts 26 shown in FIGS. 2 to 4, which is also the position shown in FIG. 7, there is a space between these fingers 42, through which the shackle 21 can be engaged. The same form is such that, as shown in FIG. 8, the shackle 21 has to be removed between the fingers 42 in order to allow one of the parts 26 and then the other to be pivoted into the position of the parts 26 which is depicted in the left-hand side of FIG. 8, allowing the device 20 to be engaged or disengaged with respect to the retaining support 2.

The shape of the external edges of these fingers 42 is rounded, for the reason explained hereinbelow.

One of the link rods 27 is mounted to pivot on the flange 30 while the other link rod 27 is mounted to pivot on the flange 31, as can be seen in FIGS. 3 or 6. These pivoting movements are achieved by means of pegs 50 which project from the internal faces of the flanges 30, 31.

FIGS. 5 to 10 depict the link rod 27 mounted on the flange 30, the flange 31-link rod 27 assembly being removed for the clarity of the drawing. It can be seen that each link rod 27 has a bulged part extending, on the same side as its pivot pin, into the central part of the opening 35, and a curved part extending on the other side of the pivot pin and comprising a roller 52 at its free end. This roller 52 is able to roll against the outer edge of the corresponding finger 42.

In the normal position of pivoting of the parts 26 which position is shown in FIG. 5, the parts of the link rods 27 which are located in the central part of the opening 35 cover the region 37 and keep the shackle 21 out of this region 37. When the user exerts tension on the shackle 21 in a direction roughly at right angles to the retaining support 2, the shackle 21 causes the link rods 27 to pivot and engages in the region 37, as shown in FIGS. 6 and 7. This tension on the shackle 21 can be exerted either directly, in the event of harnessing by the chest, to negotiate a vertical portion of the retaining support 2, or on the lifeline, in the other portions of the retaining support 2.

The device can then be moved along the retaining support 2 and can negotiate the structures 3.

FIG. 8 shows that the link rods 27 can retract by pivoting in order not to impede the positioning of the parts 26 with a view to allowing the device 20 to be engaged or disengaged with respect to the retaining support 2. These link rods 27 may also be retracted by pivoting in order not to impede the arrival of a part 26 in an intensive clamping position, as shown in respect of the left-hand part 26 in FIG. 9 or in respect of the lower part 26 in FIG. 10.

Each locking assembly 28 for its part comprises a slider 55 and a ball 56. The slider 55 can move along a slot formed in the runner 32 and is normally kept, by a spring (not depicted), in the positions shown in FIG. 4.

The balls 56 are engaged in conical holes in this part 32, which open into the internal face of this part 32 and into the bottom of said slot. These holes lie facing the normal positions of the sliders 55 which are shown in FIG. 4.

Each ball 56 is able to move between a deployed position visible in FIG. 3, in which it is normally held by the associated slider 55, and a retracted position; in its deployed position, the balls 56 project beyond the internal face of the part 32 until they lie in the path of the corresponding edge 48 but is retained by the hole in which it lies; in its retracted position, the ball 56 is entirely retracted into this hole.

As can be seen in FIG. 7, each locking assembly is positioned in such a way that the edge 48 of the corresponding cam butts against the ball 56 in the position of the parts 26 which is depicted in this figure, and this has the effect of limiting the pivoting of these parts 26 inward.

To bring one of the parts 26, followed by the other, into its position of engagement/disengagement of the device 20 with respect to the retaining support 2, it is necessary to move the ball 56 out of the way by moving the slider 55 in the direction of the arrows impressed on the part 32, visible in FIG. 4.

In practice, if the user wishes to climb up or down a ladder 4 he attaches his harness to the device 20 via the shackle 21. As he climbs, he pulls slightly on the shackle 21, imparting enough tension to bring the parts 26 into the position shown in FIG. 7, which allows the device 20 to move.

If he falls, this tension is no longer exerted, and this immediately immobilizes the device 20 on the retaining support 2 then the shackle 21 comes to bear against the lower finger 42, as shown in FIG. 10, which immediately and completely jams this device 20.

To negotiate a horizontal 2d or inclined 2b portion of the retaining support 2, the user harnesses himself to the device 20 using the lifeline, on which he exerts tension to allow the device 20 to move along the retaining support 2 and to negotiate the structures 3. The parts 26, because of their spacing, stabilize the device 20; the region 37 and the regions 38 stabilize the shackle 21 to avoid any unwanted jamming of the device 20.

FIGS. 11 to 18 depict one form of embodiment of the device 20 which is very similar to the one which has just been explained. The elements which have already been described, which are found again in this second embodiment, are denoted by the same numerical references.

As shown by these figures, the device 20 is not equipped with link rods 27 but comprises a flexible small cable 60 connecting the fingers 42 to one another. This small cable 60 allows the fingers 42 to pivot into the various aforementioned positions shown in FIGS. 14 and 15, and does not impede the pivoting of the parts 26 in the event of a fall, into the positions shown in FIGS. 16 to 18.

FIGS. 19 to 26 depict an embodiment of the device 20 in which embodiment the elements already described, denoted by the same numerical references, can be found again.

In this case, the device 20 is a one-way device, in that it allows jamming in just one direction of sliding along the cable 2. Just one of the cams 41 has a finger 42, and this finger 42 is equipped with a ring 70, made to pivot with respect to it. This ring 70, as can be deduced from FIG. 22, allows this cam 41 to be brought into a position which allows the device 20 to slide along the cable 2 when tension is exerted on the shackle 21 at right angles to this cable 2. It is apparent from FIG. 24 that the shackle 21 has to be withdrawn from the ring 70 in order to allow this cam 41 to be brought into the position depicted that allows the cable 2 to be introduced between it and the runner 32.

The second cam 41 serves essentially to guide the device 20. It is normally kept in the position shown in FIG. 22 and can be pivoted into a position that allows the cable 2 to be engaged between it and the runner 32.

It goes without saying that the invention is not restricted to the embodiments described hereinabove by way of examples but that it, on the other hand, encompasses all alternative forms thereof. Thus, the device may be moved along the retaining support by sliding, slipping or rolling; this retaining device may be flexible or rigid, and may in particular consist of a cable, a rope or a rail.

What is claimed is:

1. A fall-arresting device intended to prevent any load that has to be moved around at a height from falling, comprising:

a body which has a curved runner, adapted to be engageable over and movable along a flexible rigid retaining support;

two jamming cams mounted so that they can pivot on the body into a retracted position and an active position, wherein when the device is adapted to be engaged over the retaining support, in the retracted position the cams allow the retaining support to run between them and the runner and, in the active position the cams are adapted to clamp the retaining support between them and the runner so as to prevent the device from moving along the retaining support; and a system for actuating at least one of the cams in the event of the load falling, bringing the at least one of the cams into the active position;

the device being one wherein:

the body has an elongate opening, the length of which is adapted to be parallel to the retaining support when the device is engaged over the retaining support, the opening being intended to accommodate a member that allows the load to be harnessed to the device;

the two cams are spaced apart; and the system for actuating the cams comprises two fingers, each of which is an integral part of a cam, each finger projecting on the opposite side to the runner, extending through the opening, and having a length such that it lies in the path followed by said connector in said opening in the event of the load falling, so that the connector acts on the finger in the event of such a fall so as to bring the cam connected to the finger into the active position.

2. Device as claimed in claim 1, wherein at least one cam is associated with a spring which normally keeps it in a position in which, when the device is adapted to be engaged over the retaining support, the cam is adapted to lightly clamp the retaining support to a sufficient extent to prevent the device from moving freely along the retaining support, and which device is equipped with a member for actuating the cam; wherein the member has a part against which said connector can bear and a part connected to the aforementioned finger of the cam, and is shaped so that when tension is exerted on the connector in a direction substantially perpendicular to the retaining support, it moves the finger from the aforementioned position of light clamping to the position of retraction of the cam and so that if the load falls, it does not impede the connector coming to bear against the finger.

3. The device as claimed in claim 2, wherein each cam comprises the finger for actuating it and which device comprises two link rods mounted to pivot on said body comprising (i) a first link rod of which a part, situated on one side of the axis of pivoting of the link rod, extends at the level of a central region of said opening and of which the other part, situated on the other side of this axis of pivoting, comes into engagement with one of said fingers, and (ii) a second link rod of which one part, situated on one side of the axis of pivoting of the link rod, extends at the level of the central region of said opening and of which the other part, situated on the other side of this axis of pivoting, comes into engagement with the other of said fingers.

4. The device as claimed in claim 2, wherein each cam comprises the finger for actuating it and the device comprises a flexible link connecting the two fingers together, the length of the link being such that the connector, when said tension is exerted on it, bears against a central region of this link so as to move the fingers into a position corresponding to the position of retraction of the cams.

5. The device as claimed in claim 1, wherein the edge of the body of the device delimiting the lower part of said opening has a region of concave shape in which the connector is engaged when said tension essentially perpendicular to the retaining support is exerted on it.

6. The device as claimed in claim 5, wherein said concave region is bordered by two convex regions which contribute to limiting the unwanted movement of the shackle in said opening.

7. The device as claimed in claim 1, wherein the runner and each cam are shaped in such a way as, when the cam is in a determined angular position and when the device is adapted to be engaged over the retaining support, to allow the retaining support to be engaged laterally between the runner and the cam.

8. The device as claimed in claim 7, wherein each cam and the finger connected to it are shaped in such a way that the finger finds itself near the finger of the other cam in said determined angular position, and in such a way that this same determined angular position can be reached only if the connector has been removed from said opening.

9. The device as claimed in claim 1 and which comprises at least one removable stop associated with at least one of the cams, the stop, when active, preventing the cam from entering a determined angular position that, when the device is adapted to be engaged over the retaining support, allows the retaining support to be engaged laterally between the runner and the cam and, in its retracted position, not impeding the arrival of the cam in said determined angular position.

10. The device as claimed in claim 1, wherein the load is a person.

11. The device as claimed in claim 1, wherein the retaining support is at least one of a cable, a rope, and a rail.

12. The device as claimed in claim 1 and which comprises at least two removable stops each of which is associated with one of the cams, the stops, when active, preventing the cam from entering a determined angular position that, when the device is adapted to be engaged over the retaining support, allows the retaining support to be engaged laterally between the runner and the cam and, in its retracted position, not impeding the arrival of the cam in said determined angular position.

13. The device as claimed in claim 1, wherein a member that allows the load to be harnessed to the device is a connector of a safety shackle.

* * * * *